United States Patent [19]

Bierwith

[11] Patent Number: 4,570,365

[45] Date of Patent: Feb. 18, 1986

[54] DIGGING TOOTH AND BUCKET LIP CONSTRUCTION

[76] Inventor: Robert S. Bierwith, 1331 Eastshore Hwy., Berkeley, Calif. 94710

[21] Appl. No.: 554,598

[22] Filed: Nov. 23, 1983

[51] Int. Cl.[4] ..... E02F 9/28

[52] U.S. Cl. ..... 37/141 T; 37/142 R

[58] Field of Search ..... 37/141 R, 141 T, 142 R, 37/142 A; 172/701.1, 701.3, 777, 753, 778, 766, 772, 772.5

[56] References Cited

U.S. PATENT DOCUMENTS

| | | | |
|---|---|---|---|
| 3,469,331 | 9/1969 | Wood | 37/141 R |
| 3,574,962 | 4/1971 | Smith | 37/142 R |
| 3,947,982 | 4/1976 | Mantovani | 37/141 R |
| 3,984,929 | 10/1976 | Meyer et al. | 37/141 R |
| 4,006,544 | 2/1977 | Stepe | 172/777 X |
| 4,052,803 | 10/1977 | Lanz et al. | 37/141 T |
| 4,319,415 | 3/1982 | Mayerböck et al. | 37/141 T X |
| 4,413,432 | 11/1983 | Bierwith | 37/142 A |

*Primary Examiner*—Edgar S. Burr
*Assistant Examiner*—Moshe I. Cohen
*Attorney, Agent, or Firm*—Bruce & McCoy

[57] ABSTRACT

A digging tooth and bucket lip engagement and support construction for the forward edge or cutting lip of an excavator bucket wherein the bucket is formed of sheet steel and the digging teeth provide the strength to said lip in the form of external stringers.

1 Claim, 7 Drawing Figures

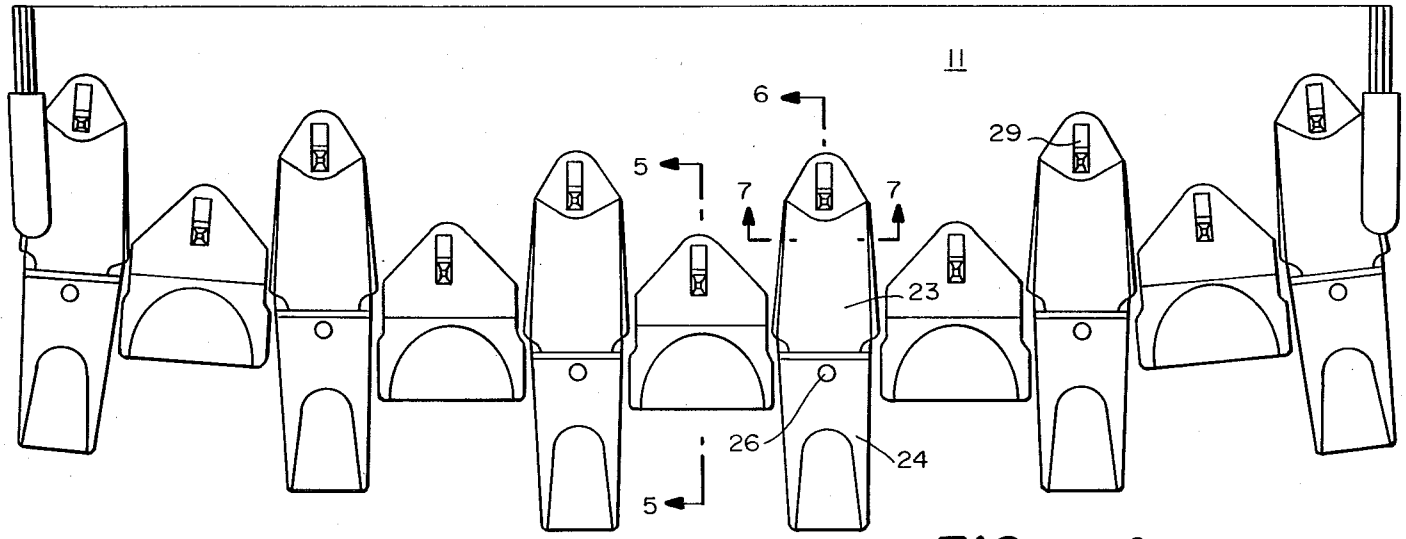
FIG.—4
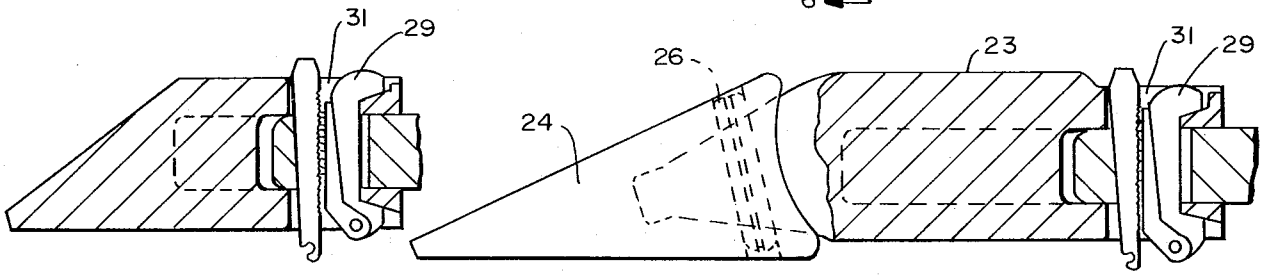
FIG.—6
FIG.—5
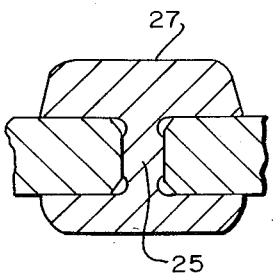
FIG.—7

DIGGING TOOTH AND BUCKET LIP CONSTRUCTION

BACKGROUND OF THE INVENTION

1. Field of the Invention

The present invention relates to digging teeth for ground engaging equipment such as excavator buckets and earth moving shovels. More particularly it relates to a type of digging tooth and bucket lip engagement and support construction wherein the bucket teeth, rather than being inserted into receptacles formed in the bucket lip, surround the bucket lip and clamp on to it to provide structural support for it.

2. Description of the Prior Art

Large earth excavators are now primarily constructed in two basic different forms. One is a large digging wheel from 50 to 100 feet in diameter having enormous excavator buckets secured to the rim of the wheel. The forward edge of the buckets are provided with replaceable digging teeth which are secured into receptacles which are disposed on the cutting edge of the bucket lip. The digging teeth are provided with a shank or stub which is inserted into holes which are formed in the front edge or lip of the bucket and are held therein by means of a removable locking pin.

The problem with these large excavator buckets is that they are extremely expensive to construct. The bucket is built up from forged pieces and sheet metal to create the elaborate yet rugged structure required to hold and support the digging teeth. The present invention permits a welded flat plate metal construction of the excavator bucket by providing additional structural support through the teeth which rather than being inserted in the bucket lip are provided with a support structure which surrounds and clamps onto the leading edge of the bucket lip where the teeth are secured to the bucket to provide additional structural support to the basic construction of the bucket.

SUMMARY OF THE INVENTION

The present invention includes a method for making a plate metal excavator bucket lip by constructing the bucket from flat plate metal, cutting locating slots and holes for the digging teeth in the lip, and then providing additional structural support for the plate metal lip by forming supporting structure for the digging teeth with an I beam type of construction which engages the slots formed in the lip. The I beam construction includes a web portion which fills the slot in the lip and the top and bottom cap portions of the I beam support structure clamp on to opposite sides of the plate adjacent the slot formed in the lip. The tooth supporting structure has a close tolerance fit with respect to the slot and the bucket lip whereby any incipient deformation of the lip is resisted by the structure.

The construction of the digging tooth and bucket lip for the forward or cutting edge of an excavator bucket lip includes a slot in the bucket lip and a locking pin hole disposed in the lip rearward of the slot. A bucket tooth supporting structure having a bucket lip engaging portion including a web portion and top and bottom cap portions, which are secured to opposite ends (the top and bottom) of the web portion, has the web portion of the tooth disposed in the slot when the tooth is secured to the lip. The cap portions clamp on to opposite sides of the lip adjacent the slot and cover the slot for the length thereof and for a distance laterally therefrom.

Means are provided for securing a tooth to the supporting structure and for securing the supporting structure to the bucket lip.

In operative position the tooth supporting structure provides strength in the form of integral stringers to the plate metal bucket.

OBJECTS OF THE INVENTION

It is therefore an important object of the present invention to provide a digging tooth and bucket lip engagement construction which eliminates the need for receptacles for the teeth formed in the leading edge of the bucket whereby a flat plate metal construction can be employed.

It is another object of the present invention to provide a digging tooth and bucket lip engagement construction which provides structural support for the forward edge of the bucket lip due to the configuration of the teeth and their bucket engaging construction.

It is a further object of the present invention to provide a means for producing a much less expensive digging bucket for ground engaging and excavator machinery.

And it is still another object of the present invention to provide a digging tooth and bucket engagement configuration which is much less expensive to maintain than the excavator buckets heretofore available in the marketplace.

Other objects of the present invention will become apparent when the preferred embodiment thereof as described in this specification is considered in conjunction with the accompanying drawings.

DESCRIPTION OF THE DRAWINGS

FIG. 4 is a top plan view of the bucket lip shown in FIG. 1 with the digging teeth engaged with the bucket lip;

FIG. 5 is a side elevation and partial section taken along lines 5—5 of FIG. 4;

FIG. 6 is a partial section in side elevation thereof taken along lines 6—6 of FIG. 4; and FIG. 7 is partial section in rear elevation taken along lines 7—7 of FIG. 4.

DESCRIPTION OF THE PREFERRED EMBODIMENT

Figure 1:
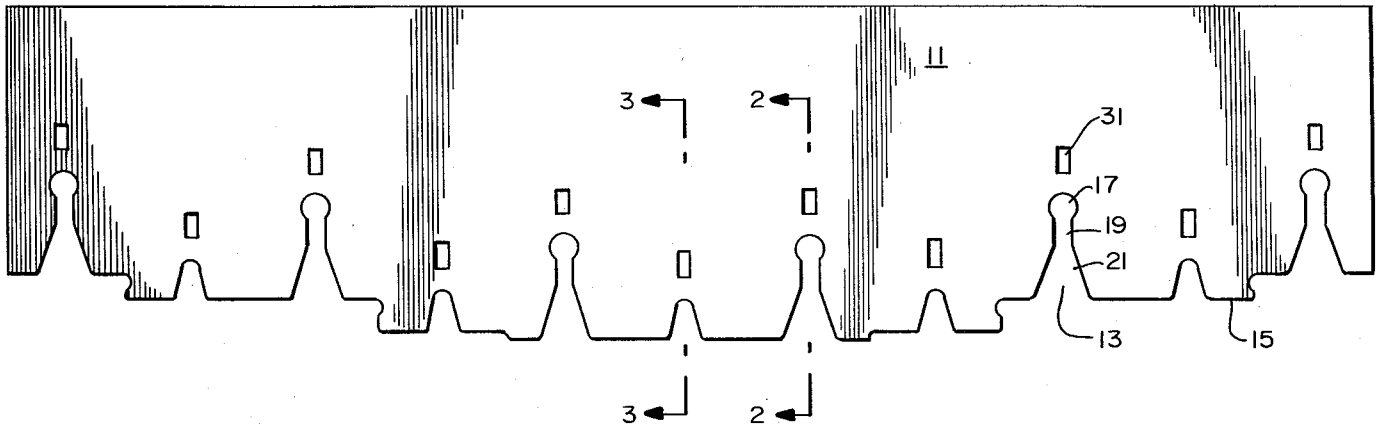
FIG. 1 is a top plan view of the digging lip of an excavator bucket employing the digging tooth and bucket lip engagement and support construction of the preferred embodiment of the present invention.
Figure 3:
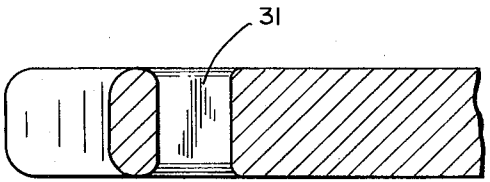
FIG. 3 is a partial section thereof taken along lines 3—3 of FIG. 1.
Figure 2:
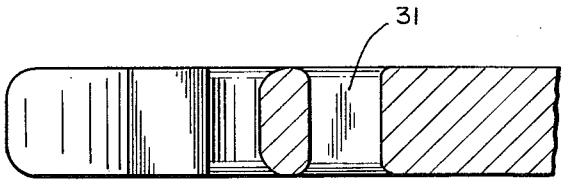
FIG. 2 is a side elevation in partial section thereof taken along lines 2—2 of FIG. 1.

The excavator bucket of the preferred embodiment present invention is constructed of plate steel, and the only preparation that the bucket lip 11 needs in order to receive the digging teeth is to be machined into a configuration which will accept the teeth and their supporting structure. This configuration can be formed by simply burning out the excess metal with a torch and then polishing to the required specifications. The uniform thickness of the plate steel stock allows accurate matching engagement of the digging teeth onto this, in effect, machined surface so that the engagement structure can be made with close tolerances for engaging the bucket lip with a clamping action which effects integral engagement throughout the contact of the tooth with the lip.

The digging tooth engagement means formed in the lip includes slots 13 which extend rearward from the leading edge 15 of the bucket lip. Each slot is formed with a vertical cylindrical configuration 17 through the plate metal at the rear end thereof which is preferably of a larger diameter than the narrowest width of the slot which it forms the rear terminus of. This is in order to provide stress relief at the rear of the slot to prevent cracks from forming. The radius of curvature of the slot is greater than one half the width of the portion of the slot immediately forward of the cylindrical portion.

The tooth engagement slot has a constant width portion 19 formed immediately forward of the cylindrical slot and an expanding width portion 21 formed forward thereof which terminates with the widest width merging into the leading edge of the bucket lip. In other words, starting with the slot at the front edge of the lip of the bucket, it narrows proceeding rearward of that forward edge until it merges with the constant width portion of the slot.

The digging tooth has a supporting structure 23 which includes a bucket lip engaging portion. This engagement portion is an important part of the invention in that it is the element which runs rearward of the forward edge of the bucket lip and provides the structural strength to it. A replaceable hard surfaced tip 24 is secured to the supporting structure by a removeable locking pin 26.

The engaging portion includes a web portion 25 and top and bottom cap portions 27 and 29 respectively. The cap portions are secured to opposite ends of the web portion. A vertical cross-section taken anywhere along the web through the support structure reveals an I beam configuration.

When the bucket tooth supporting structure is engaged with the leading edge of the bucket lip, the web portion of the tooth supporting structure is disposed in the slot formed in the bucket lip and the cap portions clamp on to opposite sides of the bucket lip adjacent to the slot and cover the slot for the length thereof and for a distance laterally therefrom. In other words, the caps extend outward from the slots for a portion of the distance between the slots in the lip laterally of said slots.

The web portion is of a constant width where it fits into the constant width slot and then the web portion widens out towards the edges of the caps towards the front of the tooth supporting structure. The web portion of the tooth has a width to fill the slot in the lip except for the rear end thereof which is not wider than the narrowest width of the slot so that the tooth can be removed from the lip without mechanical interference by sliding it forward out of the slot.

The rear end of the tooth supporting structure extends rearward of the slot in the lip and a locking clamp hole 31 extends through both of the top and bottom cap portions as well as through the lip of the bucket rearward of the back end of the slot. A locking clamp 33 is provided which engages both the top and bottom cap portions of the tooth and the lip to hold the tooth in position on the lip when it is disposed in operating position thereon. The tooth is removed from the lip by unlocking the clamp, removing it from the hole, and sliding the tooth forward out of the slot. A locking clamp of the type used herewith is disclosed in U.S. patent application Ser. No. 396,763.

The present invention also includes the method of forming a bucket lip out of plate metal rather than it being cast or constructed out of built up materials. In is done by providing locating slots for the digging teeth in the forward or leading edge of a plate metal bucket lip. Then, by providing structural support for the plate metal lip by the teeth with an I beam type construction which engages the slots. Strength for the lip is provided by the digging teeth. The structure that is provided includes an I beam construction in the tooth forming a web portion which fills the slot in the lip and top and bottom cap portions which clamp on to opposite sides of the plate of the lip adjacent the slot. The tooth supporting structure has a close tolerance fit with respect to the slot in the plate metal lip whereby an incipient deformation of the lip is resisted or prevented by the tooth supporting structure.

As a result of this method of construction, a much lighter weight excavator bucket is provided which reduces energy requirements for operating the digging wheel. The plate metal construction is considerably cheaper to manufacture than is the forged, cast, or metal formed excavator buckets of the prior art. The teeth are simply cast and forged and are not much more expensive to manufacture than the teeth of the prior art, except for the bare weight of the metal, which is negligible, and the teeth perform the double function of providing strength to the bucket while acting as the cutting edge of the bucket.

It will be seen from this description of the preferred embodiment of the present invention that all of the objects and advantages attributable thereto have been obtained, and while the invention has been described in considerable detail, the invention is not to be limited to such details as have been set forth herein except as may be necessitated by the appended claims.

I claim:

1. A digging tooth and bucket lip engagement construction for the forward edge of a plate metal bucket lip comprising a multiplicity of slots in said plate metal bucket lip having a vertical partial cylindrical configuration at the rear end thereof with a radius of curvature of generation approximately equal to one-half or greater than one-half the width of the slot immediately adjacent and forward of the cylindrical section, every other of said slots having a constant width portion immediately forward of said cylindrical portion and an expanding width portion being widest at the front edge of said lip and narrowing to merge with the constant width portion of said slot rearward of said lip edge, the rest of said slots not having constant width portions but only expanding width portions, said slots being spaced to dispose each of said tooth supporting structures in close relation to each other along the front edge of said bucket lip, a locking clamp hole disposed in said lip rearward of each of said slots, a bucket tooth supporting structure disposed in each of said slots, said structure having a bucket lip engaging portion including a web portion and top and bottom cap portions secured to opposite ends of said web portion, said web portion being disposed in said slot and having a width to fill the slot in said lip except for the rear end thereof which is not wider than the narrowest width of the slot so that the tooth can be removed from the lip by sliding the tooth forward out of the slot, said cap portions of said tooth supporting structure clamping onto opposite sides of said bucket lip adjacent to said slot and covering said slot for the length thereof and extending rearward of said slot on opposite sides of said plate in close relation thereto thereby sandwiching said plate metal bucket lip to provide structural support to said lip and in effect form a substantially thicker metal plate lip in the area of said support structure, the rearward projection of said cap portions from the rear end of said slot being a substantial portion of the length of said tooth supporting structure, said cap portions of said support structure also covering opposite sides of said plate metal bucket lip laterally from said slot for a distance on each side thereof approximately equal to the height of the web of said tooth supporting structure, means for securing a tooth to said supporting structure, locking clamp holes disposed at the rearward end of each of said tooth supporting structures extending through both the top and bottom cap portions, and a quick release locking clamp engaging each of said tooth supporting structures and said plate metal lip to hold said structures engaged with said lip when disposed in operating position on said lip.

* * * * *